United States Patent [19]

Marchetti et al.

[11] Patent Number: 4,937,180

[45] **Date of Patent: * Jun. 26, 1990**

[54] PHOTOGRAPHIC EMULSIONS CONTAINING INTERNALLY MODIFIED SILVER HALIDE GRAINS

[75] Inventors: Alfred P. Marchetti, Penfield; Woodrow G. McDugle; Raymond S. Eachus, both of Rochester, all of N.Y.

[73] Assignee: Eastman Kodak Company, Rochester, N.Y.

[ * ] Notice: The portion of the term of this patent subsequent to May 30, 2006 has been disclaimed.

[21] Appl. No.: 179,378

[22] Filed: Apr. 8, 1988

[51] Int. Cl.[5] ..... G03C 1/06

[52] U.S. Cl. ..... 430/567; 430/569; 430/596; 430/604; 430/605; 430/606; 430/612

[58] Field of Search ..... 430/604, 605, 606, 596, 430/612, 567, 569

[56] References Cited

U.S. PATENT DOCUMENTS

| | | | |
|---|---|---|---|
| 2,448,060 | 8/1948 | Smith et al. | 430/603 |
| 3,790,390 | 2/1974 | Shiba et al. | 430/567 |
| 3,890,154 | 6/1975 | Ohkubo et al. | 430/434 |
| 4,126,472 | 11/1978 | Sakai et al. | 430/264 |
| 4,147,542 | 4/1979 | Habu et al. | 430/346 |
| 4,643,965 | 2/1987 | Kubota et al. | 430/567 |
| 4,835,093 | 5/1989 | Janusonis et al. | 430/567 |

FOREIGN PATENT DOCUMENTS

| | | | |
|---|---|---|---|
| 0242190A2 | 10/1987 | European Pat. Off. . | |
| 62-212641 | 9/1987 | Japan | 430/605 |

OTHER PUBLICATIONS

*Research Disclosure*, vol. 176, Dec. 1978, Item 17643, Section IA.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978.

At the 1982 International Congress of Photographic Science at the University of Cambridge, R. S. Eachus presented a paper titled, "The Mechanism of $IR^{3+}$ Sensitization of Silver Halide Materials".

*Primary Examiner*—Roland E. Martin
*Assistant Examiner*—Janet C. Baxter
*Attorney, Agent, or Firm*—Carl O. Thomas

[57] ABSTRACT

Photographic emulsions are disclosed comprised of radiation sensitive silver bromide grains optionally containing iodide. The grains exhibit a face centered cubic crystal lattice structure and are formed in the presence of a hexacoordination complex of rhenium, ruthenium, or osmium with at least four cyanide ligands.

16 Claims, 1 Drawing Sheet

PHOTOGRAPHIC EMULSIONS CONTAINING INTERNALLY MODIFIED SILVER HALIDE GRAINS

FIELD OF THE INVENTION

The invention relates to photography. More specifically, the invention relates to photographic silver halide emulsions and to photographic elements containing these emulsions.

DEFINITION OF TERMS

All references to periods and groups within the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

The term "dopant" refers to a material other than a silver or halide ion contained within a silver halide grain.

The term "transition metal" refers to any element of groups 3 to 12 inclusive of the periodic table of elements.

The term "heavy transition metal" refers to transition metals of periods 5 and 6 of the periodic table of elements.

The term "light transition metal" refers to transition metals of period 4 of the periodic table of elements.

The term "palladium triad transition metals" refers to period 5 elements in groups 8 to 10 inclusive—i.e., ruthenium, rhodium, and palladium.

The term "platinum triad transition metals" refers to period 6 elements in groups 8 to 10 inclusive—i.e., osmium, iridium, and platinum.

The acronym "EPR" refers to electron paramagnetic resonance.

The acronym "ESR" refers to electron spin resonance.

The term "$pK_{sp}$" indicates the negative logarithm of the solubility product constant of a compound.

Grain sizes, unless otherwise indicated, are mean effective circular diameters of the grains, where the effective circular diameter is the diameter of a circle having an area equal to the projected area of the grain.

Photographic speeds are reported as relative speeds, except as otherwise indicated.

The term "extended exposure reciprocity failure" refers to the loss of speed which an emulsion exhibits when its time of exposure is extended beyond 0.01 second.

PRIOR ART

Trivelli and Smith U.S. Pat. No. 2,448,060, issued Aug. 31, 1948, taught that silver halide emulsions can be sensitized by adding to the emulsion at any stage of preparation—i.e., before or during precipitation of the silver halide grains, before or during the first digestion (physical ripening), before or during the second digestion (chemical ripening), or just before coating, a compound of a palladium or platinum triad transition metal, identified by the general formula:

$$R_2MX_6$$

wherein

R represents a hydrogen atom, an alkali metal atom, or an ammonium radical,

M represents a palladium or platinum triad transition metal, and

X represents a halogen atom—e.g., a chlorine or bromine atom.

The formula compounds are hexacoordinated heavy transition metal complexes which are water soluble. When dissolved in water $R_2$ dissociates as two cations while the transition metal and halogen ligands disperse as a hexacoordinated anionic complex.

With further investigation the art has recognized a distinct difference in the photographic effect of transition metal compounds in silver halide emulsions, depending upon whether the compound is introduced into the emulsion during precipitation of silver halide grains or subsequently in the emulsion making process. In the former instance it has been generally accepted that the transition metal can enter the silver halide grain as a dopant and therefore be effective to modify photographic properties, though present in very small concentrations. When transition metal compounds are introduced into an emulsion after silver halide grain precipitation is complete, the transition metals can be absorbed to the grain surfaces, but are sometimes largely precluded from grain contact by peptizer interactions. Orders of magnitude higher concentrations of transition metals are required to show threshold photographic effects when added following silver halide grain formation as compared to transition metals incorporated in silver halide grains as dopants. The art distinction between metal doping, resulting from transition metal compound addition during silver halide grain formation, and transition metal sensitizers, resulting from transition metal compound addition following silver halide grain formation, is illustrated by *Research Disclosure*, Vol. 176, December 1978, Item 17643, wherein Section IA, dealing with metal sensitizers introduced during grain precipitation, and Section IIIA, dealing with metal sensitizers introduced during chemical sensitization, provide entirely different lists of prior art teachings relevant to each practice. *Research Disclosure* is published by Kenneth Mason Publications, Ltd., Emsworth, Hampshire P010 7DD, England.

Since transition metal dopants can be detected in exceedingly small concentrations in silver halide grains and since usually the remaining elements in the transition metal compounds introduced during grain precipitation are much less susceptible to detection (e.g., halide or aquo ligands or halide ions), grain analysis has focused on locating and quantifying the transition metal dopant concentration in the grain structure. While Trivelli and Smith taught to employ only anionic hexacoordinated halide complexes of transition metals, many if not most listings of transition metal compounds to be introduced during silver halide grain formation have indiscriminately lumped together simple salts of transition metals and transition metal complexes. This is evidence that the possibility of ligand inclusion in grain formation or any modification in performance attributable thereto was overlooked.

In fact, a survey of the photographic literature identifies very few teachings of adding to silver halide emulsions during grain formation compounds of transition metals in which the transition metal is other than a palladium and platinum triad transition metal and the remainder of the compound is provided by other than halide ligands, halide and aquo ligands, halides which dissociate to form anions in solution, or ammonium or alkali metal moieties that dissociate to form cations in solution. The following is a listing of the few variant teachings that have been identified:

Shiba et al U.S. Pat. No. 3,790,390 discloses preparing a blue responsive silver halide emulsion suitable for flash exposure which can be handled under bright yellowish-green light. The emulsion contains grains with a mean size no larger than 0.9 μm, at least one group 8–10 metal compound, and a formula specified merocyanine dye. Examples of transition metal compounds are simple salts of light transition metals, such as iron, cobalt, and nickel salts, and hexacoordinated complexes of light transition metals containing cyano ligands. Significantly, there is no teaching or suggestion of employing cyano ligands with heavy transition metals. Heavy transition metal compounds are disclosed only as the usual simple salts or hexacoordinated complexes containing only halide ligands. Palladium (II) nitrate, a simple salt, is also disclosed as well as palladium tetrathiocyanatopalladate (II), a tetracoordinated complex of palladium.

Ohkubo et al U.S. Pat. No. 3,890,154 and Habu et al U.S. Pat. No. 4,147,542 are similar to Shiba et al, differing principally in employing different sensitizing dyes to allow recording of green flash exposures.

Sakai et al U.S. Pat. No. 4,126,472 discloses producing a high contrast emulsion suitable for lith photography by ripening an emulsion containing at least 60 mole percent silver chloride in the presence of $10^{-6}$ to $10^{-4}$ mole per mole of silver halide of a water soluble iridium salt and further adding a hydroxytetraazaindene and a polyoxyethylene compound. In addition to the usual iridium halide salts and hexacoordinated iridium complexes containing halide ligands Sakai et al discloses cationic hexacoordinated complexes of iridium containing amine ligands. Since iridium is introduced after silver halide precipitation is terminated, the iridium is not employed as a grain dopant, but as a grain surface modifier. This undoubtedly accounts for the variance from conventional iridium compounds used for doping.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug 20–26, 1978, reported investigations of chloride iridium, rhodium, and gold complexes and, in addition, an emulsion prepared by introducing $(NH_4)_6Mo_7O_{24}4H_2O$. The latter dissociates in water to form a molybdenum cluster having a net negative charge of −6. Neither the +6 oxidation state ascribed to molybdenum nor the −6 valence of the anionic cluster should be confused with a hexacoordinated complex of a single transition metal atom.

At the 1982 International Congress of Photographic Science at the University of Cambridge, R. S. Eachus presented a paper titled, "The Mechanism of $Ir^{3+}$ Sensitization of Silver Halide Materials", wherein inferential electron paramagnetic resonance (EPR) spectroscopic evidence was presented that $Ir^{3+}$ ions were incorporated into melt-grown silver bromide and silver chloride crystals as $(IrBr_6)^{-3}$ and $(IrCl_6)^{-3}$. In emulsions and sols of these salts, the hexabromoiridate and hexachloroiridate molecular ions, as well as similar complexes containing mixed halides, were introduced during precipitation. The aquated species $[IrCl_4(H_2O)_2]^{-1}$ and $[IrCl_5(H_2O)]^{-2}$ were also successfully doped into precipitates of both silver salts. Eachus went on to speculate on various mechanisms by which incorporated iridium ions might contribute to photogenerated free electron and hole management, including latent image formation. B. H. Carroll, "Iridium Sensitization: A Literature Review", *Photographic Science and Engineering*, Vol. 24, No. 6, Nov./Dec. 1980, pp. 265–267, is cited for further background.

Greskowiak published European Patent Application 0,242,190/A2 discloses reductions in high intensity reciprocity failure in silver halide emulsions formed in the presence of one or more complex compounds of rhodium (III) having 3, 4, 5, or 6 cyanide ligands attached to each rhodium ion.

RELATED PATENT APPLICATIONS

McDugle et al U.S. Ser. No. 179,376, filed concurrently herewith and commonly assigned, titled PHOTOGRAPHIC EMULSIONS CONTAINING INTERNALLY MODIFIED SILVER HALIDE GRAINS, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements.

Keevert et al U.S. Ser. No. 179,377, filed concurrently herewith and commonly assigned, titled PHOTOGRAPHIC EMULSIONS CONTAINING INTERNALLY MODIFIED SILVER HALIDE GRAINS, discloses emulsions comprised of radiation sensitive silver halide grains containing greater than 50 mole percent chloride and less than 5 mole percent chloride, any residual halide beng bromide. The grains exhibit a face centered cubic crystal lattice structure and are formed in the presence of a hexacoordination complex of rhenium, ruthenium, or osmium with at least four cyanide ligands. The emulsion exhibits increased sensitivity.

Janusonis et al, U.S. Ser. No. 179,380, concurrently filed and commonly assigned, titled INTERNALLY DOPED SILVER HALIDE EMULSIONS now U.S. Pat. No. 4,835,093, discloses photographic emulsions comprised of silver halide grains exhibiting a face centered cubic crystal lattice structure and internally containing rhenium.

SUMMARY OF THE INVENTION

In one aspect this invention is directed to a photographic emulsion comprised of radiation sensitive silver bromide grains optionally containing iodide. The grains exhibit a face centered cubic crystal lattice structure formed in the presence of a hexacoordination complex of rhenium, ruthenium, osmium, or iridium with at least four cyanide ligands.

Surprisingly, increased stability, both in terms of observed speed and minimum density, are produced in silver bromide and bromoiodide emulsions formed in the presence of these rhenium, ruthenium, osmium, and iridium coordination complexes. Additionally, reductions in low intensity reciprocity failure are observed in these emulsions.

DESCRIPTION OF PREFERRED EMBODIMENTS

Figure 1:
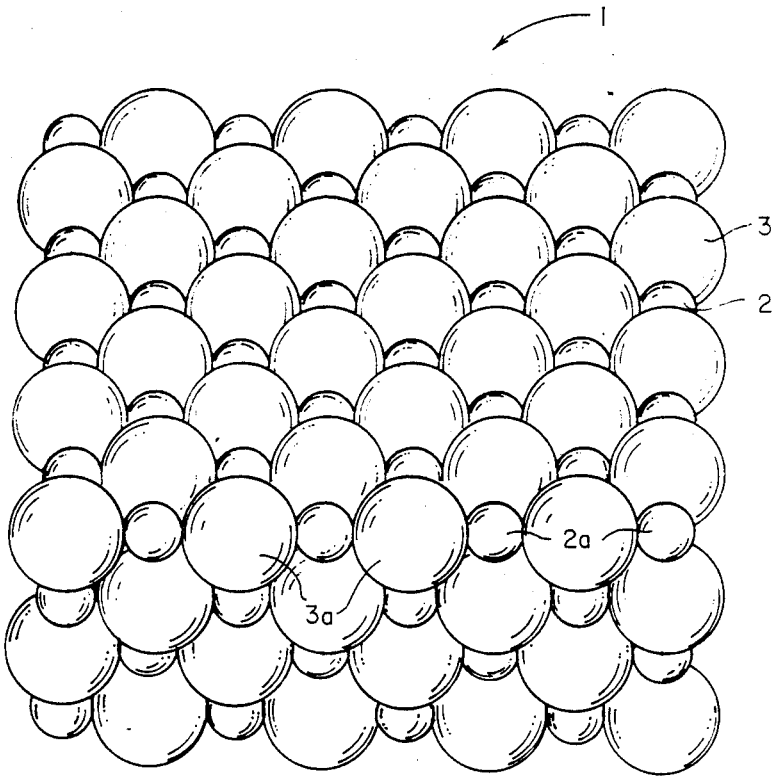
FIG. 1 is a schematic view of a silver bromide crystal structure with the upper layer of ions lying along a {100} crystallographic face.

The present invention is directed to silver bromide and bromoiodide emulsions which exhibit increased sensitivity. Such emulsions contain bromide optionally in combination with iodide up to its solubility limit in silver bromide—that is, up to about 40 mole percent, based on total silver. Typically iodide is present in silver bromoiodide grains in concentrations ranging from 0.1 to 20 mole percent, most commonly from about 1 to 10 mole percent.

It has been discovered quite unexpectedly that both the stability, both in terms of speed and contrast, of these emulsions can be increased when the grains of the emulsion are formed in the presence of a hexacoordination complex of rhenium, ruthenium, osmium, or iridium with at least four cyanide ligands. Additionally, reductions in the low intensity reciprocity failure of these emulsions has been observed.

It is in fact believed that the entire hexacoordinated transition metal complex is incorporated intact in the grains being formed. To understand how this can be possible, it is helpful to first review the structure of silver halide grains. Unlike silver iodide, which commonly forms only $\beta$ and $\gamma$ phases and is rarely used in photography, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of atoms shown counting from the bottom of FIG. 1 lie in a {100} crystallographic plane which perpendicularly intersects the {100} crystallographic plane occupied by the upper layer of ions. The row containing silver ions 2a and bromide ions 3a lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The manner in which a hexacoordinated transition metal complex can be incorporated in the grain structure can be roughly appreciated by considering the characteristics of a single silver ion and six adjacent halide ions (hereinafter collectively referred to as the seven vacancy ions) that must be omitted from the crystal structure to accommodate spatially the hexacoordinated transition metal complex. The seven vacancy ions exhibit a net charge of $-5$. This suggests that anionic transition metal complexes should be more readily incorporated in the crystal structure than neutral or cationic transition metal complexes. This also suggests that the capability of a hexacoordinated heavy transition metal complex to trap either photogenerated holes or electrons may be determined to a significant degree by whether the complex introduced has a net charge more or less negative than the seven vacancy ions it displaces. This is an important departure from the common view that heavy transition metals are incorporated into silver halide grains as bare ions or atoms and that their hole or electron trapping capability is entirely a function of their oxidation state.

Referring to FIG. 1, it should be further noted that the silver ions are much smaller than the bromide ions, though silver lies in the 5th period while bromine lies in the 4th period. Further, the lattice is known to accommodate iodide ions (in concentrations of up to 40 mole percent, noted above) which are still larger than bromide ions. This suggests that the size of 5th and 6th period transition metals should not in itself provide any barrier to their incorporation. A final observation that can be drawn from the seven vacancy ions is that the six halide ions exhibit an ionic attraction not only to the single silver ion that forms the center of the vacancy ion group, but are also attracted to other adjacent silver ions.

Hexacoordinated complexes exhibit a spatial configuration that is compatible with the face centered cubic crystal structure of photographically useful silver halides. The six ligands are spatially comparable to the six halide ions next adjacent to a silver ion in the crystal structure. To appreciate that a hexacoordinated complex of a heavy transition metal having ligands other than halide ligands or, as recognized by Eachus, cited above, aquo ligands, can be accommodated into silver halide cubic crystal lattice structure it is necessary to consider that the attraction between the transition metal and its ligands is not ionic, but the result of covalent bonding, the latter being much stronger than the former. Since the size of a hexacoordinated complex is determined not only by the size of the atoms forming the complex, but also by the strength of the bonds between the atoms, a hexacoordinated complex can be spatially accommodated into a silver halide crystal structure in the space that would otherwise be occupied by the seven vacancy ions, even though the number and/or diameters of the individual atoms forming the complex exceeds that of the vacancy ions. This is because the covalent bond strength can significantly reduce the bond distances and therefore the size of the entire complex. It is a specific recognition of this invention that multielement ligands of hexacoordinated transition metal complexes can be spatially accommodated to single halide ion vacancies within the crystal structure.

While spatial compatibility is important in choosing suitable hexacoordinated transition metal complexes, another factor which must be taken into account is the compatibility of the complex with the next adjacent ions in the crystal lattice structure. It is the recognition of this invention that compatibility can be realized by choosing bridging ligands for the transition metal complex. Looking at a single row of silver and halide ions in a cubic crystal lattice structure, the following relationship can be observed:

$$Ag^+ X^- Ag^+ X^- Ag^+ X^- Ag^+ X^-, \text{ etc.}$$

Notice that the halide ions X are attracting both adjacent silver ions in the row. When the portion of a hexacoordinated transition metal complex lying in a single row of silver and halide ions in a crystal structure is considered, the following relationship can be observed:

$$Ag^+ X^- Ag^+ -L-M-L- Ag^+ X^-, \text{ etc.}$$

where

M represents a heavy transition metal and

L represents a bridging ligand.

While only one row of silver and halide ions is shown, it is appreciated that the complex forms part of three identical perpendicular rows of silver and halide ions having the heavy transition metal M as their point of intersection. However, since the three rows are identical, the relationships can be appreciated from considering a single row.

Transition metal coordination complexes satisfying the requirements of this invention are those which contain rhenium, ruthenium, osmium, or iridium as a transition metal and 4, 5, or 6 cyanide ligands. When only 4 or 5 cyanide ligands are present, the remaining ligands or ligand can be any convenient conventional bridging ligand. The latter when incorporated in the silver halide crystal structure are capable of serving as bridging groups between two or more metal centers. These bridging ligands can be either monodentate or ambidentate. A monodentate bridging ligand has only one ligand atom that forms two (or more) bonds to two (or more) different metal atoms. For monoatomic ligands and for those containing only one donor atom, only the monodentate form of bridging is possible. Multielement ligands with more than one donor atom can also function in a bridging capacity and are referred to as ambidentate ligands. Preferred bridging ligands are monoatomic monodentate ligands, such as halides. Fluoride, chloride, bromide, and iodide ligands are all specifically contemplated. Multielement ligands, such as azide and thiocyanate ligands, are also specifically contemplated.

The hexacoordinated rhenium, ruthenium, osmium, and iridium cyanide complexes contemplated for grain incorporation in most instances exhibit a net ionic charge. One or more counter ions are therefore usually associated with the complex to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

In a preferred form the hexacoordinated rhenium, ruthenium, osmium, and iridium cyanide complexes can be represented by the following formula: (I)

$$[M(CN)_{6-y}L_y]^n$$

where

M is rhenium, ruthenium, osmium, or iridium,

L is a bridging ligand, y is the integer zero, 1, or 2, and n is −2, −3, or −4.

Table I provides a listing of illustrative ruthenium and osmium cyanide coordination complexes satisfying the requirements of the invention:

TABLE I

| | |
|---|---|
| TMC-1 | $[Re(CN)_6]^{-4}$ |
| TMC-2 | $[Ru(CN)_6]^{-4}$ |
| TMC-3 | $[Os(CN)_6]^{-4}$ |
| TMC-4 | $[ReF(CN)_5]^{-4}$ |
| TMC-5 | $[RuF(CN)_5]^{-4}$ |
| TMC-6 | $[OsF(CN)_5]^{-4}$ |
| TMC-7 | $[ReCl(CN)_5]^{-4}$ |
| TMC-8 | $[RuCl(CN)_5]^{-4}$ |
| TMC-9 | $[OsCl(CN)_5]^{-4}$ |
| TMC-10 | $[ReBr(CN)_5]^{-4}$ |
| TMC-11 | $[RuBr(CN)_5]^{-4}$ |
| TMC-12 | $[OsBr(CN)_5]^{-4}$ |
| TMC-13 | $[ReI(CN)_5]^{-4}$ |
| TMC-14 | $[RuI(CN)_5]^{-4}$ |
| TMC-15 | $[OsI(CN)_5]^{-4}$ |

TABLE I-continued

| | |
|---|---|
| TMC-16 | $[ReF_2(CN)_4]^{-4}$ |
| TMC-17 | $[RuF_2(CN)_4]^{-4}$ |
| TMC-18 | $[OsF_2(CN)_4]^{-4}$ |
| TMC-19 | $[ReCl_2(CN)_4]^{-4}$ |
| TMC-20 | $[RuCl_2(CN)_4]^{-4}$ |
| TMC-21 | $[OsCl_2(CN)_4]^{-4}$ |
| TMC-22 | $[RuBr_2(CN)_4]^{-4}$ |
| TMC-23 | $[OsBr_2(CN)_4]^{-4}$ |
| TMC-24 | $[ReBr_2(CN)_4]^{-4}$ |
| TMC-25 | $[RuI_2(CN)_4]^{-4}$ |
| TMC-26 | $[OsI_2(CN)_5]^{-4}$ |
| TMC-27 | $[Ru(CN)_5(OCN)]^{-4}$ |
| TMC-28 | $[Os(CN)_5(OCN)]^{-4}$ |
| TMC-29 | $[Ru(CN)_5(SCN)]^{-4}$ |
| TMC-30 | $[Os(CN)_5(SCN)]^{-4}$ |
| TMC-31 | $[Ru(CN)_5(N_3)]^{-4}$ |
| TMC-32 | $[Os(CN)_5(N_3)]^{-4}$ |
| TMC-33 | $[Ru(CN)_5(H_2O)]^{-3}$ |
| TMC-34 | $[Os(CN)_5(H_2O)]^{-3}$ |
| TMC-35 | $[Ir(CN)_6]^{-3}$ |
| TMC-36 | $[Ir(CN)_5Cl]^{-3}$ |
| TMC-37 | $[Ir(CN)_5Br]^{-3}$ |
| TMC-38 | $[Ir(CN)_5I]^{-3}$ |
| TMC-39 | $[Ir(CN)_4Cl_2]^{-3}$ |
| TMC-40 | $[Ir(CN)_4Br_2]-3$ |
| TMC-41 | $[Ir(CN)_4I_2]^{-3}$ |
| TMC-42 | $[Ir(CN)_5(N_3)]^{-3}$ |
| TMC-43 | $[Ir(CN)_5(H_2O)]^{-2}$ |

Procedures for beginning with the compounds of Table I and preparing photographic silver halide emulsions benefitted by incorporation of the hexacoordinated rhenium, ruthenium, osmium, or iridium cyanide complex can be readily appreciated by considering the prior teachings of the art relating to introducing heavy transition metal dopants in silver halide grains. Such teachings are illustrated by Wark U.S. Pat. No. 2,717,833; Berriman U.S. Pat. No. 3,367,778; Burt U.S. Pat. No. 3,445,235; Bacon et al U.S. Pat. No. 3,446,927; Colt U.S. Pat. No. 3,418,122; Bacon U.S. Pat. No. 3,531,291; Bacon U.S. Pat. No. 3,574,625; Japanese Patent (Kokoku) 33781/74 (priority May 10, 1968); Japanese Patent (Kokoku) 30483/73 (priority Nov. 2, 1968); Ohkubo et al U.S. Pat. No. 3,890,154; Spence et al U.S. Pat. Nos. 3,687,676 abd 3,690,891; Gilman et al U.S. Pat. No. 3,979,213; Motter U.S. Pat. No. 3,703,584; Japanese Patent (Kokoku) 32738/70 (priority Oct. 22, 1970); Shiba et al U.S. Pat. No. 3,790,390; Yamasue et al U.S. Pat. No. 3,901,713; Nishina et al U.S. Pat. No. 3,847,621; *Research Disclosure*, Vol. 108, Apr. 1973, Item 10801; Sakai U.S. Pat. No. 4,126,472; Dostes et al Defensive Publication T962,004 and French Patent No. 2,296,204; U.K. Specification No. 1,527,435 (priority Mar. 17, 1975); Japanese Patent Publication (Kokai) 107,129/76 (priority Mar. 18, 1975); Habu et al U.S. Pat. Nos. 4,147,542 and 4,173,483; *Research Disclosure*, Vol. 134, June 1975, Item 13452; Japanese Patent Publication (Kokai) No. 65,432/77 (priority Nov. 26, 1975); Japanese Patent Publication (Kokai) No. 76,923/77 (priority Dec. 23, 1975); Japanese Patent Publication (Kokai) No. 88,340/77 (priority Jan. 26, 1976); Japanese Patent Publication (Kokai) No. 75,921/78 (priority Dec. 17, 1976); Okutsu et al U.S. Pat. No. 4,221,857; Japanese Patent Publication (Kokai) No. 96,024/79 (priority Jan. 11, 1978); *Research Disclosure*, Vol. 181, May 1979, Item 18155; Kanisawa et al U.S. Pat. No. 4,288,533; Japanese Patent Publication (Kokai) No. 25,727/81 (priority Aug. 7, 1979); Japanese Patent Publication (Kokai) No. 51,733/81 (priority Oct. 2, 1979); Japanese Patent Publication (Kokai) No. 166,637/80 (priority Dec. 6, 1979); and Japanese Patent Publication (Kokai) No.

149,142/81 (priority Apr. 18, 1970); the disclosures of which are here incorporated by reference.

When silver halide grains are formed a soluble silver salt, usually silver nitrate, and one or more soluble halide salts, usually an ammonium or alkali metal halide salt, are brought together in an aqueous medium. Precipitation of silver halide is driven by the high $pK_{sp}$ of silver halides, ranging from 9.75 for silver chloride to 16.09 for silver iodide at room temperature. For the rhenium, ruthenium, osmium, or iridium cyanide complex to coprecipitate with silver halide it must also form a high $pK_{sp}$ compound. If the $pK_{sp}$ is too low, precipitation may not occur. On the other hand, if the $pK_{sp}$ is too high, the compound may precipitate as a separate phase. Optimum $pK_{sp}$ values for silver counter ion compounds of rhenium, ruthenium, osmium, or iridium cyanide complexes contemplated for use in the practice of this invention are in or near the range of $pK_{sp}$ values for photographic silver halides—that is, in the range of from about 8 to 20, preferably about 9 to 17.

Apart from the incorporated hexacoordinated heavy transition metal complexes satisfying the requirements of the invention the silver halide grains, the emulsions of which they form a part, and the photographic elements in which they are incorporated can take any of a wide variety of conventional forms. A survey of these conventional features as well as a listing of the patents and publications particularly relevant to each teaching is provided by *Research Disclosure*, Item 17643, cited above, the disclosure of which is here incorporated by reference. It is specifically contemplated to incorporate hexacoordinated heavy transition metal complexes satisfying the requirements of this invention in tabular grain emulsions, particularly thin (less than 0.2 μm) and/or high aspect ratio (>8:1) tabular grain emulsions, such as those disclosed in Wilgus et al U.S. Pat. No. 4,434,226; Kofron et al U.S. Pat. No. 4,439,520; Daubendiek et al U.S. Pat. Nos. 4,414,310 and 4,693,964; Abbott et al U.S. Pat. Nos. 4,425,425 and 4,425,426; Solberg et al U.S. Pat. No. 4,433,048; Dickerson U.S. Pat. No. 4,414,304; Mignot U.S. Pat. No. 4,386,156; Jones et al U.S. Pat. No. 4,478,929; Evans et al U.S. Pat. No. 4,504,570; Maskasky U.S. Pat. Nos. 4,435,501, 4,643,966, 4,684,607, and 4,713,320; and Sowinski et al U.S. Pat. No. 4,656,122; the disclosures of which are here incorporated by reference.

It has been determined by imagewise exposure, bleaching of surface latent image, and then development in an internal developer, that increased internal sensitivity can be imparted to the emulsions by precipitating the grains in the presence of hexacoordinated rhenium, ruthenium, osmium, or iridium cyanide complexes of the type described above. Effective concentrations of the emulsion range from about $1\times10^{-6}$ mole of complex per silver mole. The complex can be incorporated into the grains up to its solubility limit, typically about $5\times10^{-4}$ mole per silver mole. An excess of the complex over its solubility limit in the grain can be tolerated, but normally any such excess is removed from the emulsion during washing. Preferred concentrations of the complex for achieving internal sensitivity are from $10^{-5}$ to $10^{-4}$ mole per silver mole.

It has been surprisingly discovered that the incorporation of the hexacoordinated rhenium, ruthenium, osmium, and iridium cyanide complexes in silver bromide and bromoiodide emulsions during grain formation results in obtaining more stable emulsions. The emulsions vary less in speed and minimum density on keeping when a hexacoordinated rhenium, ruthenium, osmium, or iridium cyanide complex is incorporated during grain formation.

Additionally, and equally surprisingly, reduced low intensity reciprocity failure is observed in the emulsions of the invention.

EXAMPLES

The invention can be better appreciated by reference to the following specific examples:

EXAMPLES 1-9

A series of silver bromide octahedral emulsions of 0.45 μm average edge length were prepared, differing in the hexacoordinated heavy transition metal complex incorporated in the grains.

Control 1A was made with no heavy transition metal complex present according to the following procedure:

Six solutions were prepared as follows:

Solution 1(1)

Gelatin (bone):50 gm
D. W.:2000 mL

Solution 2(1)

Sodium bromide:10 gm
D. W.:100 mL

Solution 3(1)

Sodium bromide:412 gm
D. W. to total vol.:1600 mL

Solution 4(1)

Silver nitrate (5 Molar):800 mL
D. W. to total vol.:1600 mL

Solution 5(1)

Gelatin (phthalated):50 gm
D. W.:300 mL

Solution 6(1)

Gelatin (bone):130 gm
D. W.:400 mL

Solution 1(1) was adjusted to a pH of 3.0 with nitric acid at 40° C. The temperature of solution 1(1) was adjusted to a 70° C. Solution 1(1) was then adjusted to a pAg of 8.2 with solution 2(1). Solutions 3(1) and 4(1) were simultaneously run into the adjusted solution 1(1) at a constant rate for the first 4 minutes with introduction being accelerated for the next 40 minutes. The addition rate was held constant over a final 2 minute period for a total addition time of 46 minutes. The pAg was maintained at 8.2 over the entire run. After the addition of solutions 3(1) and 4(1), the temperature was adjusted to 40° C. and solution 5(1) was added. The mixture was then held for 5 minutes, after which the pH was adjusted to 2.7 and the gel allowed to settle. At the same time the temperature was dropped to 15° C. before decanting the liquid layer. The depleted volume was restored with distilled water. The pH was readjusted at 4.0, and the mixture held at 40° C. for ½ hour before the pH was adjusted to 2.7 and the settling and decanting steps were repeated. Solution 6(1) was added, and the pH and pAg were adjusted to 5.6 and 8.2, respectively. The emulsion was sulfur sensitized by digesting with 4 mg/mole of $Na_2S_2O_3.5H_2O$ for 40 minutes at 70° C. Coatings were made at 27 mg Ag/dm$^2$ and 36 mg gelatin/dm$^2$. The samples were exposed to 365 nm radiation for 0.01, 0.1, 1.0, and 10.0 seconds and developed for 6 minutes in a hydroquinone-Elon ® (N-methyl-p-aminophenol hemisulfate) developer.

Control 1A' was prepared (including digestion) identically to Control Emulsion 1A. This emulsion was included to indicate batch to batch variances in emulsion performance.

Examples 1B, 1C, and 1D, and Control 1E differed from Control 1A in that Solutions 7(1), 8(1), 9(1), and 10(1), respectively, were added to Solution 3(1) after the first four minute nucleation period and during the first 35 minutes of the growth period. Some of Solution 3(1) was kept in reserve and was the source of the transition metal complex free sodium bromide added during the last 7 minutes of the preparation.

Solutions 7(1), 8(1), 9(1), and 10(1) were prepared by dissolving 2 to 100 mg of $K_4Os(CN)_6$ (see Table II) in that part of Solution 3(1) added during the 32 to 40 minute growth period in the preparation of these emulsions. This transition metal complex reduces extended exposure reciprocity failure.

Examples 1F, 1G, and 1H differed from Examples 1B–1E in that 17 to 83 mg of the transition metal complex $K_4Ru(CN)_6$ was used to make solutions 11(1), 12(1), and 13(1) (see Table II).

Example II differed from Examples 1B–1H in that the transition metal complex employed was 47 mg of $K_2Ir(CN)_6$ (see Table II).

Control 1J differed from Control 1A in that Solution 3(15) was divided in half and 12 g of NaI was added to the first half to be used in the precipitation. This is shown in Table II.

Example 1K differed from Control 1J in that 50 mg of $K_4Os(CN)_6$ was added to the first half of Solution 3(1). This transition metal complex reduces extended exposure reciprocity failure. This is shown by comparison with Control 1J in Table II.

The difference in speed (Δ log E) reported is the difference between the observed speed at 0.01 second exposure and the observed speed at 10 seconds exposure. All exposures were at 365 nm.

TABLE II

| Ex/-Cont. | Transition Metal Complex Formula | Micromole/-Ag Mole | mg Added | Δ log E |
|---|---|---|---|---|
| 1A | — | — | — | −0.32 |
| 1A' | — | — | — | −0.35 |
| 1B | $K_4Os(CN)_6$ | 25 | 50 | −0.24 |
| 1C | $K_4Os(CN)_6$ | 10 | 20 | −0.20 |
| 1D | $K_4Os(CN)_6$ | 50 | 100 | −0.20 |
| 1E | $K_4Os(CN)_6$ | 1 | 2 | −0.38 |
| 1F | $K_4Ru(CN)_6$ | 25 | 41 | −0.12 |
| 1G | $K_4Ru(CN)_6$ | 50 | 83 | −0.12 |
| 1H | $K_4Ru(CN)_6$ | 10 | 17 | −0.28 |
| 1I | $K_3Ir(CN)_6$ | 2* | 47 | −0.29 |
| 1J | — | — | — | −0.34 |
| 1K | $K_4Os(CN)_6$ | 25 | 50 | −0.13 |

*Actual incorporation based on analysis

EXAMPLES 10–11

Emulsions 2A', 2C, 2F, 2H, and 2I otherwise corresponding to Control 1A' and Examples 1C, 1F, 1H, and 1I, respectively, were digested with 2 mg per Ag mole of $Na_2S_2O_3.5H_2O$ and, in a separate sample, with 2 mg per Ag mole $Na_2S_2O_3.5H_2O$ and 3 mg per Ag mole $KAuCl_4$ for 40 minutes at 70° C. These emulsions were then coated as indicated in Example 1 above. The emulsions were then processed for 6 minutes in a hydroquinone-Elon ® (N-methyl-p-aminophenol hemisulfate) developer both fresh (within one week of coating) and after a number of months (see Table III) of keeping at room temperature (21°±2° C.) and ambient humidity (50%±10 Rel. Hum.). The emulsions with grains containing transition metal complexes showed improved keeping properties. Examples 2C, 2F, 2H, and 2I exhibited smaller variations in speed and smaller increases in fog ($D_{min}$) than Control 2A'.

TABLE III

| Ex/-Cont. | Transition Metal Complex Formula | Micromole/-Ag Mole | Δ log E/Δ Fog S Sens. | S/Au Sens |
|---|---|---|---|---|
| 2A' | — | — | 0.36/0.53 | 0.25/0.28 |
| 2C | $K_4Os(CN)_6$ | 10 | 0.20/0.03 | 0.18/0.13 |
| 2F | $K_4Ru(CN)_6$ | 25 | 0.19/0.02 | 0.15/0.40 |
| 2H | $K_4Ru(CN)_6$ | 10 | 0.30/0.02 | 0.07/0.17 |
| 2I | $K_3Ir(CN)_6$ | 2* | 0.23/0.00 | 0.17/0.08 |

*Actual incorporation based on analysis

The invention has been described in detail with particular reference to preferred embodiments thereof, but it will be understood that variations and modifications can be effected within the spirit and scope of the invention.

What is claimed is:

1. A photographic emulsion comprised of radiation sensitive silver bromide grains optionally containing iodide, said grains exhibiting a face centered cubic crystal lattice structure formed in the presence of a hexacoordination complex of rhenium, ruthenium, osmium, or iridium with at least four cyanide ligands.

2. A photographic emulsion according to claim 1 further characterized in that said grains contain from about 0.1 to 20 mole percent iodide, based on total silver.

3. A photographic emulsion according to claim 2 further characterized in that said grains contain less from about 1 to 10 mole percent iodide, based on total silver.

4. A photographic emulsion according to claim 1 further characterized in that silver halide forming said grains consists essentially of silver bromoiodide.

5. A photographic emulsion according to claim 1 further characterized in that silver halide forming said grains consists essentially of silver bromide.

6. A photographic emulsion according to claim 1 further characterized in that said silver halide grains exhibit at least one of sulfur and gold surface sensitization.

7. A photographic emulsion according to claim 1 further characterized in that said rhenium, ruthenium, osmium, or iridium is present in said emulsion in a concentration of from $1\times10^{-6}$ to $5\times10^{-4}$ mole per silver mole.

8. A photographic emulsion according to claim 1 further characterized in that said hexacoordination complex satisfies the formula:

$$[M(CN)_{6-y}L_y]^n$$

where

M is rhenium, ruthenium, osmium, or iridium,

L is a bridging ligand, y is the integer zero, 1, or 2, and n is −2, −3, or −4.

9. A photographic emulsion according to claim 8 further characterized in that L is a halide ligand.

10. A photographic emulsion according to claim 1 further characterized in that said grains contain at least one of rhenium, ruthenium, osmium, and iridium and cyanide ligands.

11. a photographic emulsion according to claim 10 further characterized in that said hexcoordination complex is present in a stabilizing amount.

12. A photographic emulsion according to claim 11 further characterized in that said complex is present in a concentration of from $10^{-5}$ to $10^{-4}$ mole per silver mole.

13. A photographic emulsion comprised of radiation sensitive silver bromide grains surface sensitized with sulfur, said grains exhibiting a face centered cubic crystal lattice structure formed in the presence from $1\times10^{-6}$ to $5\times10^{-4}$ mole per silver mole of a hexacoordination complex of the formula:

$$[M(CN)_{6-y}L_y]^{-4}$$

where

M is ruthenium or osmium,

L is halide, and y is the integer zero, 1, or 2.

14. A photographic emulsion according to claim 13 further characterized in that y is zero.

15. A photographic emulsion comprised of radiation sensitive silver bromide grains surface sensitized with sulfur, said grains exhibiting a face centered cubic crystal lattice structure formed in the presence from $1\times10^{-6}$ to $5\times10^{-4}$ mole per silver mole of a hexacoordination complex of the formula:

$$[Ir(CN)_{6-y}L_y]^{-3}$$

where

L is halide and y is the integer zero, 1, or 2.

16. A photographic emulsion according to claim 15 further characterized in that y is zero.

* * * * *